United States Patent [19]

Utsunomiya et al.

[11] Patent Number: 5,035,855

[45] Date of Patent: Jul. 30, 1991

[54] MARTENSITIC PRECIPITATION-HARDENABLE STAINLESS STEEL

[75] Inventors: Takeshi Utsunomiya; Kazuo Hoshino; Sadao Hirotsu, all of Yamaguchi, Japan

[73] Assignee: Nisshin Steel Company, Ltd., Tokyo, Japan

[21] Appl. No.: 462,969

[22] Filed: Jan. 4, 1990

Related U.S. Application Data

[63] Continuation of Ser. No. 636,350, Jul. 31, 1984, abandoned.

[30] Foreign Application Priority Data

Aug. 5, 1983 [JP] Japan ..... 58-143587

[51] Int. Cl.[5] ..... C22C 38/44

[52] U.S. Cl. ..... 420/61; 420/57; 420/58; 420/68

[58] Field of Search ..... 420/61, 68, 57, 58, 420/63; 148/326, 325

[56] References Cited

U.S. PATENT DOCUMENTS

| | | | |
|---|---|---|---|
| 3,658,513 | 4/1972 | Clarke, Jr. | 75/125 |
| 3,690,896 | 9/1972 | Mikhailovich et al. | 75/124 C |

FOREIGN PATENT DOCUMENTS

| | | | |
|---|---|---|---|
| 54-71025 | 6/1979 | Japan | 148/37 |
| 57-16154 | 1/1982 | Japan | 75/128 T |
| 1018674 | 1/1966 | United Kingdom | 75/128 T |

*Primary Examiner*—Deborah Yee

*Attorney, Agent, or Firm*—Webb, Burden, Ziesenheim & Webb

[57] ABSTRACT

A martensitic precipitation-hardenable stainless steel essentially consisting of, in weight percent, not more than 0.08% C, 0.5–4.0% Si, not more than 4.0% Mn, 5.0–9.0% Ni, 10.0–17.0% Cr, more than 0.3% and up to 2.5% Mo, 0.15–1.0% Ti, not more than 1.0% Al and not more than 0.03% N and the balance being Fe, and inevitable incidental impurities, which may contain 0.3–2.5% Cu is disclosed. This steel has low hardness before aging and exhibits high strength and good toughness after aging.

6 Claims, 3 Drawing Sheets

MARTENSITIC PRECIPITATION-HARDENABLE STAINLESS STEEL

This is a continuation of application Ser. No. 06/636,350 filed on Jul. 31, 1984, now abandoned.

TECHNICAL FIELD OF THE INVENTION

This invention relates to martensitic precipitation-hardenable stainless steel which has low hardness before aging and exhibits high strength and good toughness after aging.

BACKGROUND OF THE INVENTION

When springs are manufactured of a high strength stainless steel, punching and forming are involved. Therefore, it is desired that the material is of low hardness before the aging treatment and is of high hardness after the aging treatment.

However, work-hardenable stainless steels represented by AISI 301 steel and precipitation-hardenable stainless steels represented by 17-7 PH steel, which have been conventionally used for manufacturing springs, must be heavily cold-worked in order to enhance hardness after aging. Accordingly, hardness in the cold-worked state before aging is inevitably high. That is, they are defective in that hardness before aging and hardness after aging cannot be separately controlled. These steels are also defective in that difficulties accompany the production thereof and yet adequate hardness after aging cannot be achieved.

Under the circumstances, we previously developed a stainless steel having the composition indicated below which exhibits martensitic structure in the solution-treated state or the lightly worked state and is improved with respect to the above-mentioned defect. This invention is disclosed in Japanese Patent Application No. 34138/80 (Laid-Open Patent Publication No. 130459/81) under the title "Precipitation-Hardenable Stainless Steel for Springs".

The steel contains, in weight percent, more than 0.03% and not more than 0.08% C, not more than 0.03% N, 0.3–2.5% Si, not more than 4.0% Mn, 5.0–9.0% Ni, 12.0–17.0% Cr, 0.1–2.5% Cu, 0.2–1.0% Ti and not more than 1.0% Al, the balance being Fe and inevitable incidental impurities, wherein the amounts of C, Ti, Mn, Ni, Cr, Cu and Al are adjusted so that the value of A' defined as $$A' = 17 \times (C\%/Ti\%) + 0.70 \times (Mn\%) + 1 \times (Ni\%) + 0.60 \times (Cr\%) + 0.76 \times (Cu\%) - 0.63 \times (Al\%) + 20.871$$

is less than 42.0, and the amounts of Mn, Ni, Cu, Cr, Ti, Al and Si are adjusted so that the value of Cr-equivalent/ni-equivalent defined as $$\frac{\text{Cr eq.}}{\text{Ni eq.}} = \frac{1 \times (Cr\%) + 3.5 \times (Ti\% + Al\%) + 1.5 \times (Si\%)}{1 \times (Ni\%) + 0.3 \times (Cu\%) + 0.65 \times (Mn\%)}$$

is not more than 2.7, and that the value of ΔHv defined as $$\Delta Hv = 205 \times [Ti\% - 3 \times (C\% + N\%)] + 205 \times (Al\% - 2 \times (N\%)] + 57.5 \times (Si\%) + 20.5 \times (Cu\%) + 20$$

is in the range of 120–210, and the steel exhibits substantially martensitic structure in the solution-treated state or in the not-more-than 50% cold-worked state.

This previously developed steel is excellent in punching and forming workability and it exhibits satisfactory properties as a spring material when ΔHv (the difference in hardnesses before and after aging) is adjusted to around 200. This steel can be easily produced since heavy cold working is not required.

In comparison with the maraging steels represented by 18 Ni maraging steel, however, this steel is slightly inferior in toughness when used for springs or for constructions in the domain of the high strength steel (around 190 kg/mm$^2$ in notch tensile strength).

We studied for improving toughness of this previously developed steel and we have found that toughness of the steel can be retained at high strength by addition of Mo. That is, we have found that toughness of the material can be well retained by addition of Mo even if ΔHv (degree of aging), which was restricted to not more than 210 in consideration of toughness in the previously developed steel, is raised to more than 210. Also we have found that enhancement of strength can be attained by addition of Mo without depending upon the precipitation hardening effect of Cu, except when Cu is necessary for improvement of corrosion resistance against the sulfurous atmosphere.

DISCLOSURE OF THE INVENTION

This invention provides a precipitation-hardenable stainless steel having excellent toughness essentially consisting of, in weight percent, not more than 0.08% C, 0.5–40% Si, not more than 4.0% Mn, 5.0–9.0% Ni, 10.0–17.0% Cr, more than 0.3% and not more than 2.5% Mo, 0.15–1.0% Ti, not more than 1.0% Al, not more than 0.03% N, and the balance being Fe and inevitable incidental impurities, and a steel which contains 0.3–2.5% Cu in addition to the above described ingredients.

In preferred embodiments, the steel contains not more than 0.06% C, 1.0–3.5% Si, not more than 1.0% Mn, 6.0–8.0% Ni, 11.0–15.0% Cr, 0.4–2.0% Mo, 0.2–0.8% Ti, not more than 0.5% Al and not more than 0.025 N.

In more preferred embodiments, the steel contains not more than 0.05% C, 1.0–2.5% Si, not more than 0.5% Mn, 6.0–7.5% Ni, 12.0–14.5% Cr, 0.5–1.5% Mo, 0.2–0.6% Ti, not more than 0.1% Al and not more than 0.020% N.

A preferred Cu content is 0.3–2.00%, and a more preferred Cu content is 0.3–1.5% Cu.

The reasons for defining the composition as above are as follows:

(1) C

In the previously developed steel, the C content was defined as more than 0.03% and not more than 0.08%. In the present invention, it is simply defined as not more than 0.08%. In the previously developed invention, the toughness after the age hardening depended on the degree of age-hardening ΔHv, and more than 0.03% C was required to secure high hardness before aging in order to obtain high strength after aging. But in the present invention, it is no longer required owing to the addition of Mo. Good toughness can be retained after aging in the ΔHv range of not less than 210, in which toughness is deteriorated in the previously developed steel. The upper limit of the C content is 0.08% in the same way as the previously developed steel, since in the range in excess of 0.08% C, the quenched martensitic phase of the matrix becomes hard and a plenty amount of Ti is required to fix C, which is uneconomical.

(2) Si

As well as in the case of the previously developed steel, the steel is hardened by fine precipitation of an intermetallic compound consisting of Ni, Ti and Si. With the Si content of less than 0.5%, the effect thereof is slight. If Si is contained in an amount in excess of about 4.0%, there is no significant effect in comparison with addition of 4.0%, and it promotes formation of δ-ferrite. Therefore, the Si content is defined as 0.5–4.0%.

(3) Mn

Mn contributes to suppression of formation of δ-ferrite. However, if Mn is added in a large amount, austenite is retained in a large amount. As a compromise, the Mn content is defined as not more than 4.0%. Incidentally, Mn inhibits formation of δ-ferrite like-Ni, and therefore, Mn can replace a portion of Ni.

(4) Ni

Ni promotes precipitation hardening and inhibits formation of δ-ferrite. However, addition of a large amount thereof increases the amount of the retained austenite. In the case of the present invention, at least 5.0% of Ni is necessary for securing precipitation hardening, but it must not be in excess of about 9.0% in order to maintain the amount of the retained austenite low.

(5) Cr

At least about 10.0% Cr is generally required to obtain corrosion resistance. But addition of a large amount of Cr increases the amount of δ-ferrite and retained austenite and therefore the upper limit is defined as 17.0%.

(6) Mo

Mo is added in order to improve toughness, more than 0.3% Mo is required therefor. However, addition of more than 2.5% does not exhibit corresponding effect in comparison with addition of 2.5%, and raises steel price. Also addition of Mo in excess of 2.5% increases formation of δ-ferrite. Thus the upper limit is defined as 2.5%.

(7) Ti

Ti is added in order to cause precipitation hardening. The effect thereof is not sufficient with the addition of less than 0.15% Ti, while addition of more than about 1.0% Ti makes the steel hard and brittle. Thus the Ti content is defined 0.15–1.0%.

(8) Al

Like Ti, Al is added to induce precipitation hardening. Addition in excess of about 1.0% decreases toughness, and thus the upper limit is defined as 1.0%. Also, Al can replace a portion of Ti.

(9) N

N has strong affinity to Ti and Al, which cause precipitation hardening, and thus impairs the effect of addition of Ti and Al. Also high content of N causes formation of large inclusions of TiN and decreases toughness. Thus lower content of N is preferred and it is limited to not more than 0.03%.

(10) Cu

In the case of the present invention, considerable strength can be secured even if precipitation effect of Cu is not depended upon. In sulfur dioxide type corrosive environments, however, sufficient corrosion resistance is not obtained by Cr and thus Cu is added. Addition of at least 0.3% Cu is necessary in order to secure corrosion resistance against sulfur dioxide type gases. The upper limit is defined as 2.5%, since a larger amount of Cu causes red shortness and thus impairs hot workability and induces surface crackings.

The steel of this present invention which is composed as described above substantially exhibits martensite structure in the state cold-worked by up to 50%.

BRIEF EXPLANATION OF THE DRAWINGS

FIG. 4 is a diagram showing the relation between degree of age hardening ΔHv and the

TABLE 1

(% by weight)

| | Sample No. | C | Si | Mn | Ni | Cr | Cu | Mo | Ti | Al | N |
|---|---|---|---|---|---|---|---|---|---|---|---|
| Invention Steels | 1 | 0.040 | 1.44 | 0.29 | 7.36 | 14.70 | 1.01 | 0.51 | 0.49 | 0.022 | 0.010 |
| | 2 | 0.010 | 3.13 | 0.33 | 7.01 | 12.33 | 0.08 | 1.03 | 0.21 | 0.025 | 0.014 |
| | 3 | 0.009 | 1.68 | 0.33 | 7.02 | 13.78 | 0.06 | 1.02 | 0.56 | 0.018 | 0.018 |
| | 4 | 0.009 | 1.60 | 0.34 | 6.50 | 14.85 | 2.03 | 0.57 | 0.39 | 0.030 | 0.014 |
| | 5 | 0.045 | 1.64 | 0.22 | 6.75 | 14.10 | 0.04 | 1.05 | 0.74 | 0.020 | 0.016 |
| | 6 | 0.037 | 0.55 | 0.32 | 7.10 | 14.31 | 0.06 | 2.11 | 0.81 | 0.022 | 0.015 |
| Comparative Steels | 7 | 0.035 | 1.50 | 0.32 | 7.10 | 14.70 | 0.55 | — | 0.70 | 0.024 | 0.012 |
| | 8 | 0.036 | 1.49 | 0.32 | 7.44 | 14.94 | 1.08 | — | 0.57 | 0.020 | 0.009 |

TABLE 2

| | Sample No. | Hardness after aging (Hv = 30 kg) | Hardness increase through aging (ΔHv) | NTS after aging (kg/mm²) |
|---|---|---|---|---|
| Invention Steels | 1 | 545 | 193 | 199 |
| | 2 | 554 | 186 | 208 |
| | 3 | 550 | 207 | 196 |
| | 4 | 547 | 222 | 201 |
| | 5 | 587 | 235 | 198 |
| | 6 | 542 | 203 | 195 |
| Comparative Steels | 7 | 590 | 232 | 115 |
| | 8 | 565 | 217 | 160 |

ratio of notch tensile strength to tensile strength of the invention steels and the comparative steels indicated in Table 1.

EMBODIMENTS OF THE INVENTION

Now the invention is explained by way of working examples.

The chemical compositions of the tested steels are listed in Table 1. Samples No. 1-6 are steels of this invention and Samples No. 7 and 8 are comparative steels which do not contain Mo which characterizes the present invention, and are adjusted so that ΔHv is greater than 210, which was the upper limit in the previously developed steel, and the steel exhibits high strength after aging.

In Table 2 are shown hardness, increase in hardness through aging and notch tensile strength (NTS) of steels listed in Table 1 which were solution-treated, cold-rolled to 1.0 mm thickness and aged at 480° C. for 1 hour.

It is apparent from Table 2 that the steels of this invention and the comparative steels are similar in hardness after aging. However, the invention steels are far higher in notch tensile strength than the comparative steels. (Refer to Sample No. 5 and 7 for instance)

Figure 1:
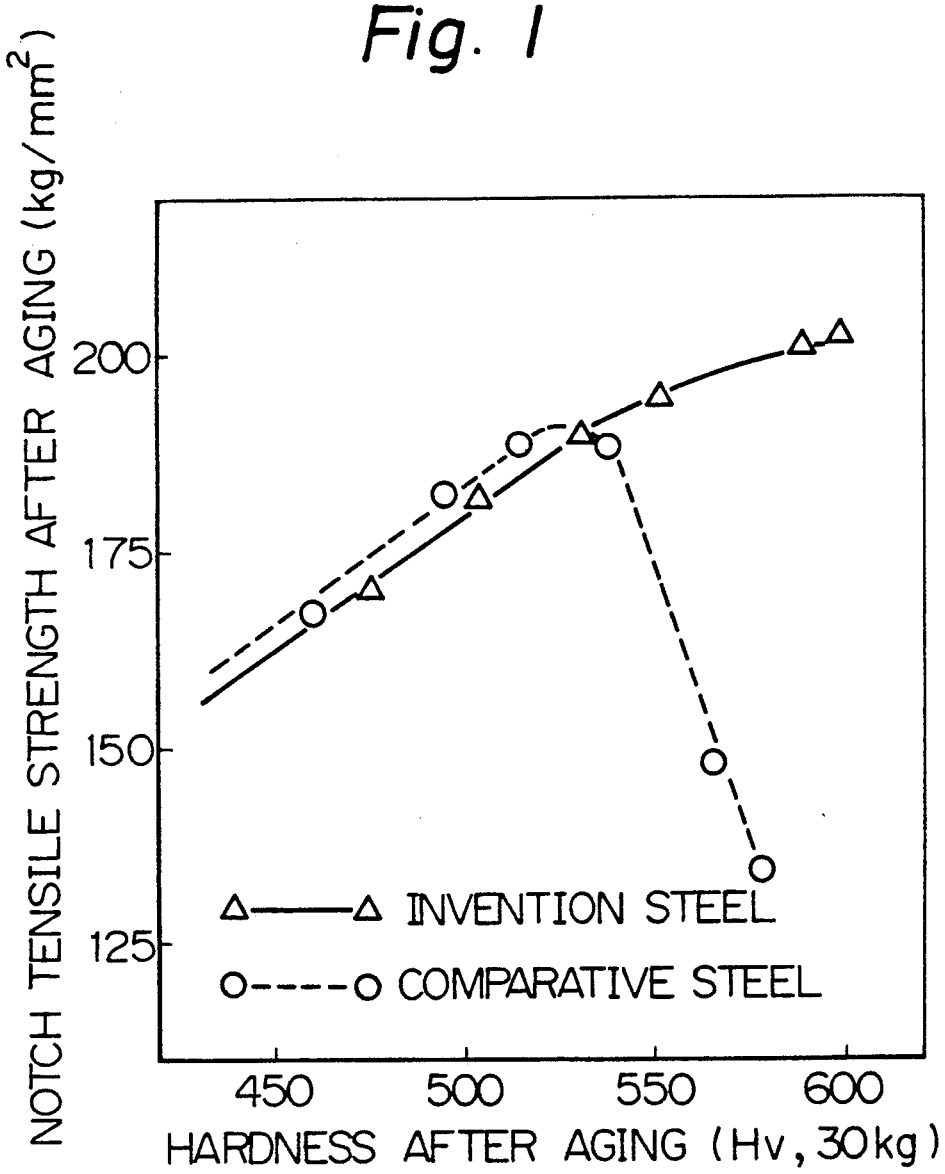
FIG. 1 is a diagram which shows the relation between hardness and notch tensile strength of an invention steel (Sample No. 3) and a comparative steel (Sample No. 8) after aging at 480° C. for varied times.

FIG. 1 shows the relation between hardness and notch tensile strength of Sample No. 3 (invention steel) and Sample No. 8 (Comparative steel) which have almost the same composition except for Mo. In the case of the steel of this invention, as hardness increases, notch tensile strength also increases, that is, toughness is well retained at high hardness. In contrast, in the comparative steel, notch tensile strength increases until hardness reaches the level of around 520 Hv, but steeply drops at the higher hardness, that is, the steel is embrittled.

Figure 2:
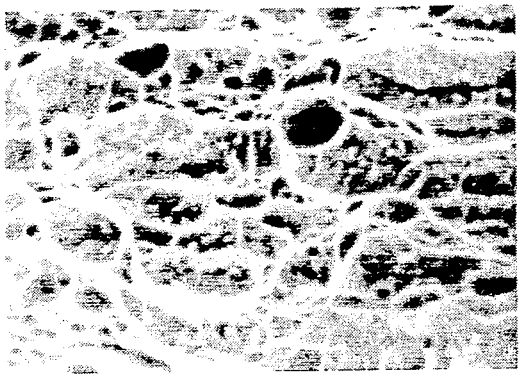
FIG. 2 is a micrograph of a fracture surface of the above-mentioned invention steel sample which was subjected to the tensile test after aging at 480° C. for 1 hour.
Figure 3:
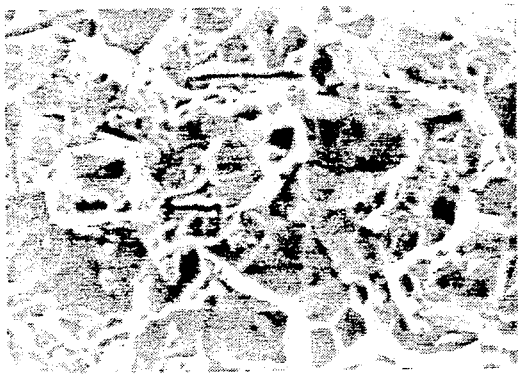
FIG. 3 is a micrograph of a fracture surface of the above-mentioned comparative steel sample tested under the same conditions.

FIG. 2 and FIG. 3 respectively show the fracture surface of the invention steel and the comparative steel used for the notch tensile test as shown in FIG. 1. The fracture surface of the invention steel exhibits dimples but that of the comparative steel exhibits intergranular fractures and cleavage fractures. These fracture surfaces also suggest that the former steel has good ductility and the latter steel is brittle. It is considered that Mo contributes to strengthening grain boundaries.

Figure 4:
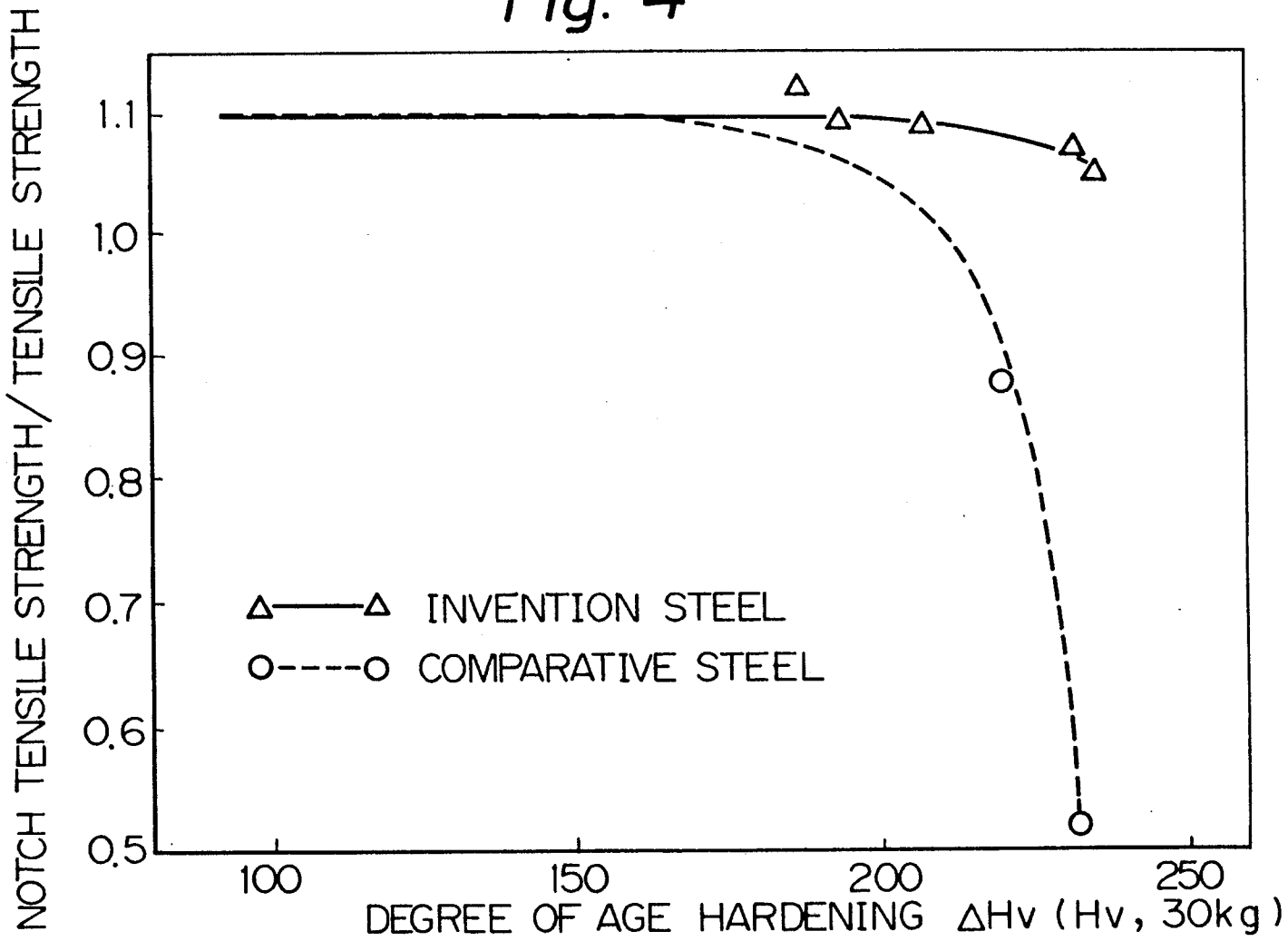

FIG. 4 is a diagram wherein the degree of age hardening ΔHv and the ratio of notch tensile strength to tensile strength (NTS/TS) of the invention steels No. 1-6 and comparative steels No. 7 and 8 are plotted. In the case of the previously developed steel, the value of NTS/TS drops to less than 1.0 at Hv of 210 and higher. In contrast, in the invention steel, high of NTS/TS ratio is well retained at higher than 1.0 even at ΔHv of 240 or higher.

INDUSTRIAL UTILIZATION OF THE INVENTION

As has been described above, the steel of the present invention is of low hardness and has excellent forming and punching workability before aging and that it has excellent toughness even when the steel is hardened by aging. The steel is used as a material not only for springs for which characteristics such as excellent spring limit value, fatigue rupture limit value, etc. are required, but also for thick plates of which high level toughness is required.

We claim:

1. A martensitic precipitation-hardenable stainless steel having excellent toughness consisting essentially of, in weight percent, not more than 0.06% C, greater than 1.0-3.5% si, not more than 1.0% Mn, greater than 6.0 up to 8.0% Ni, 12.0-15.0% Cr, 0.4-2.0% Mo, 0.2-0.8% Ti, not more than 0.5% Al and not more than 0.02% N, the remainder Fe and inevitable incidental impurities.

2. The martensitic precipitation-hardenable stainless steel having excellent toughness as claimed in claim 1, which contains, in weight percent, not more than 0.045% C, greater than 1.0 up to 2.5% Si, not more than 0.5% Mn, greater than 6.0 up to 7.5% Ni, 12.0-14.5% Cr, 0.5-1.5% Mo, 0.2-0.6% Ti and not more than 0.1% Al.

3. A martensitic precipitation-hardenable stainless steel having excellent toughness consisting essentially of, in weight percent, not more than 0.06% C, greater than 1.0 up to 3.5% Si, not more than 1.0% Mn, greater than 6.0 up to 8.0% Ni, 12.0-15.0% Cr, 0.3-2.00% Cu, 0.4-2.0% Mo, 0.2-0.8% Ti, not more than 0.5% Al and not more than 0.02% N, the remainder Fe and inevitable incidental impurities.

4. The martensitic precipitation-hardenable stainless steel having excellent toughness as claimed in claim 3, which contains, in weight percent, not more than 0.05% C, greater than 1.0 up to 2.5% Si, not more than 0.5% Mn, greater than 6.0 up to 7.5% Ni, 12.0-14.5% Cr, 0.3-1.5% Cu, 0.5-1.5% Mo, 0.20-0.6% Ti and not more than 0.1% Al.

5. A martensitic precipitation-hardenable stainless steel having excellent toughness consisting essentially of, in weight percent, not more than 0.08% C, greater than 1.0 up to 4.0% Si, not more than 4.0% Mn, greater than 6.0 up to 8.0% Ni, 12.0 to 15.0% Cr, between about 0.3% and about 1.0% Mo, 0.15-1.0% Ti, not more than 1.0% Al and not more than 0.02% N, the remainder Fe and inevitable incidental impurities.

6. A martensitic precipitation-hardenable stainless steel having excellent toughness consisting essentially of, in weight percent, not more than 0.08% C, greater than 1.0 up to 4.0% Si, not more than 4.0% Mn, greater than 6.0 up to 8.0% Ni, 12.0 to 15.0% Cr, 0.3-2.5% Cu, between about 0.3% and about 1.0% Mo, 0.15-1.0% Ti, not more than 1.0% Al and not more than 0.02% N, the remainder Fe and inevitable incidental impurities.

* * * * *